United States Patent [19]

Moscrip

[11] Patent Number: 5,063,851

[45] Date of Patent: Nov. 12, 1991

[54] EXPENDABLE BREECH GUN ROUND

[75] Inventor: William M. Moscrip, King George City, Va.

[73] Assignee: The United States of America as represented by the Secretary of the Navy, Washington, D.C.

[21] Appl. No.: 626,675

[22] Filed: Oct. 28, 1975

[51] Int. Cl.[5] ..... F42B 5/18

[52] U.S. Cl. ..... 102/433; 102/443

[58] Field of Search ..... 102/38, 40, 44, 100, 102/102, 103; 89/33 MC

[56] References Cited

U.S. PATENT DOCUMENTS

| | | | |
|---|---|---|---|
| 273,209 | 2/1883 | Wrard | 102/101 |
| 1,441,517 | 1/1923 | Miskunas | 89/33 MC |
| 1,920,075 | 7/1933 | Haenichen | 102/103 X |
| 2,317,579 | 4/1943 | Bacon | 89/33 MC |
| 2,956,500 | 10/1960 | Barr | 102/38 |
| 2,996,988 | 8/1961 | Kunz | 102/38 |
| 3,141,377 | 7/1964 | Butterworth | 89/26 X |
| 3,183,665 | 5/1965 | Webb | 102/100 |
| 3,507,219 | 4/1970 | Dardick | 102/DIG. 1 |
| 3,575,112 | 4/1971 | Farmer | 102/38 |
| 3,688,697 | 9/1972 | Paul et al. | 102/38 |

*Primary Examiner*—David H. Brown

*Attorney, Agent, or Firm*—John D. Lewis; Kenneth E. Walden

[57] ABSTRACT

A round for an expendable breech gun wherein a filament reinforced breechcase is lined with propellant throughout its length whereby the burning rate of the propellant in effect varies with projectile speed within the breechcase. A metal or plastic honeycomb bonded to the inner wall of the breechcase provides mechanical support for the propellant and precludes axial progression of the flame front in advance of the projectile. An alternative construction employs a propellant lining having a succession of increasing burning rates from the breech end to the muzzle end of the breechcase.

8 Claims, 1 Drawing Sheet

EXPENDABLE BREECH GUN ROUND

BACKGROUND OF THE INVENTION

This invention relates generally to ammunition for expendable breech guns and more particularly to a round having optimum interior ballistics.

The present invention is designed to be used in expendable breech guns which employ the fire-out-of-battery (FOOB) recoil cycle such as that shown in the copending application of W. M. Moscrip, Ser. No. 606,906, filed Aug. 20, 1975.

Since the operation of the FOOB recoil cycle is in a dynamic sense "tuned" to the magnitude of the expected firing impulse, a high degree of reproducibility in the firing impulse from round to round is essential. The standard deviation of muzzle velocity (a measure of firing impulse reproducibility) in conventional guns is on the order of 1 or 2 percent under the best conditions. This variability is due to the normal variation of a large number of contributing factors such as propellant quality, initial grain orientation, surface area regression, projectile travel, etc.; it significantly degrades the total gun system accuracy and inherently complicates the design of a FOOB recoil system.

For low pressure guns maximum firing impulse reproducibility can be achieved by interposing an orifice plate between the propellant charge and the projectile. This is the high/low interior ballistics principle in which the burning of the propellant within the high pressure chamber proceeds independently of conditions in the bore, since the flow through the orifices is choked. Variations in muzzle velocity are reduced since the effects of projectile travel are isolated from the propellant burning environment and the gas production rate or flow rate is metered by the choked flow condition. However, the high/low principle is applicable only to low pressure systems and necessarily involves the use of a costly and relatively heavy high pressure chamber.

A measure of the interior ballistic performance of a gun system is provided by the ratio of the mean base pressure required to achieve a given projectile velocity to the actual maximum space mean pressure for the system. This parameter is known as the piezometric efficiency of the ballistic cycle and reflects how well the cycle maintains the maximum operating pressure during the entire action time. It has been theoretically demonstrated that optimum piezometric efficiency can be achieved in the operation of a closed breech gun only when the burning surface area development of the propellant grains is directly proportional to the projectile velocity.

A new hypervelocity research tool for achieving projectile velocities in excess of 35,000 fps and hopefully as high as 100,000 fps has been developed. It utilizes a hypervelocity accelerator consisting of a long thick-wall gun tube lined with a thin layer or film of explosive. The explosive lining serves as a reservoir of high pressure gas that is released by the passage of the projectile. The gas forms an essentially stationary reservoir that maintains a relatively constant base pressure on the projectile. In this application, very high projectile velocities have been achieved by using lightweight projectiles in long explosive lined tubes and by drawing a vacuum ahead of the projectile prior to each shot.

SUMMARY OF THE INVENTION

The invention is an explosive or propellant lined expendable breechcase which is held in allignment with the gun tube and serves as a one-shot breech. The propellant is cast or extruded in the form of a uniformly thick cylindrical grain which is bonded to the interior surface of the breechcase. Alternatively, the breechcase may be provided with a bonded honeycomb liner which provides mechanical support for the propellant.

STATEMENT OF THE OBJECTS OF THE INVENTION

It is a primary object of this invention to provide a new and improved round for an expendable breech gun.

It is another object of this invention to provide a round for an expendable breech gun having increased reproducibility and piezometric efficiency of the firing impulse.

It is further object of this invention to provide a round for an expendable breech gun having up to 100% volumetric propellant loading density without increase in free volume behind the projectile.

DESCRIPTION OF THE PREFERRED EMBODIMENTS

Figure 1:
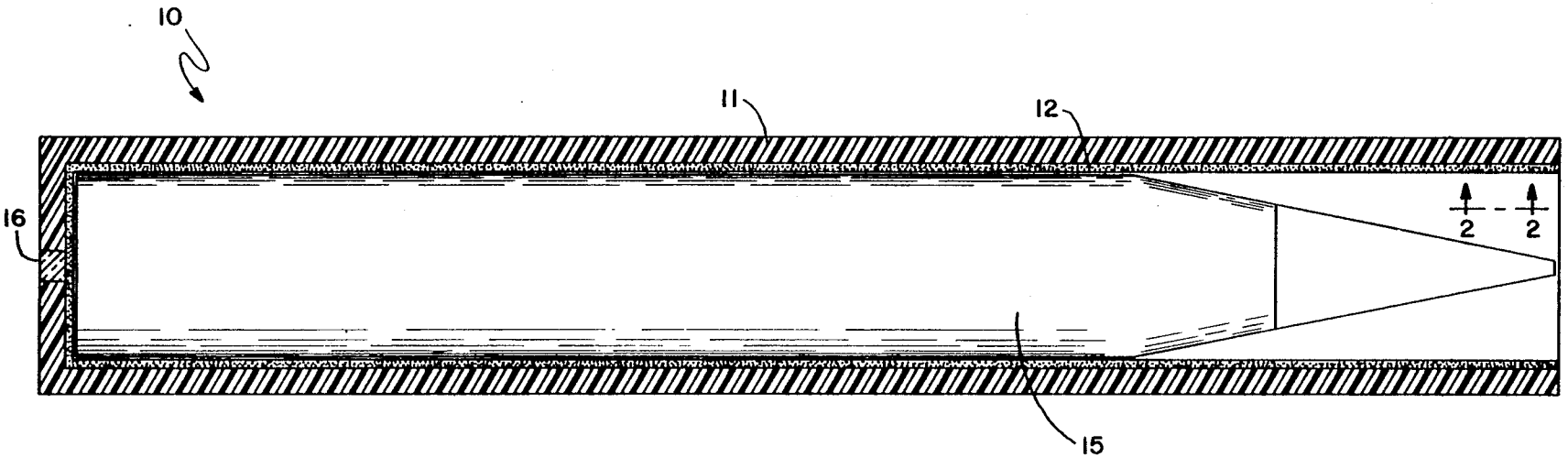
FIG. 1 is a sectional view of a round for an expendable breech gun embodying the principal features of the present invention.

Referring now to FIG. 1, there can be seen a round, designated generally by the reference numeral 10, comprising a breechcase 11 found of filament wound fiberglass or other suitable material capable of withstanding the firing pressure. A propellant grain 12 of uniform formulation is provided in the form of a liner bonded to the inner wall of the breechcase 11. Disposed within the liner 12 is a projectile 15 which may be provided with any of various obturators (not shown). The closed end of the breechcase 11 is provided with a transparent window 16 which enables laser ignition of the propellant grain 12 in the manner described in the aforementioned copending application.

Figure 2:
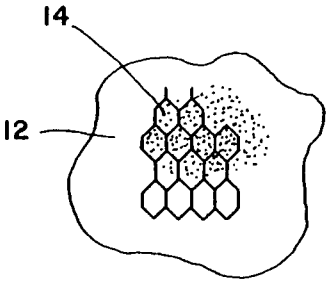
FIG. 2 is a fragmentary view taken along the line 2—2 of FIG. 1 and illustrates an alternative construction of the propellant liner.

FIG. 2 illustrates an alternative construction which uses finely divided propellant 12 incorporated within a metal or plastic honeycomb liner 14 which is bonded to the inside wall of the breechcase. The mass burning rate of finely divided propellant grains is always much larger than that of the homogeneous solid, but powdered propellant cannot provide structural support to the projectile and obturator. A practicable compromise is possible with the use of the honeycomb which not only provides the requisite structural support, but also tends to physically impede the progression of the combustion flame front in the axial direction. In addition, high thermal conductivity paths into the body of the propellant are established by the cell walls of a metal honeycomb providing additional enhancement to the radial burn rate component through heat conduction.

Another alternative construction provides a propellant grain or liner 12 which has a gradually increasing burning rate from breech end to muzzle end (left to right in FIG. 1) of the breechcase 11. This may be accomplished by blending ordinary propellants with increasing quantities of one or more members of the HIVELITE family of propellants manufactured by the McCormick-Selph Division of Teledyne Corp. These propellants have burning rates of around 1000"/sec to 100,000"/sec which are intermediate between the burning rates of ordinary propellants (inches/sec) and high explosives (7000 m/sec). The increased burning rate may then be accomplished by forming a series of discrete zones or cylindrical sections within the grain 12 or by a continuously varying composition of the propellant grain.

OPERATION

Figure 3:
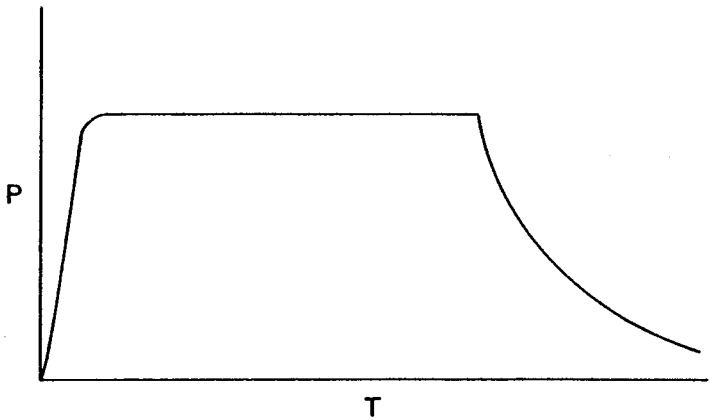
FIG. 3 is an idealized pressure vs time history of the firing of a round made in accordance with the principles of the present invention.

In order that a better understanding of the invention may be had, its mode of operation will now be described. The grain 12 is ignited behind the projectile 15 and as the projectile accelerates along the bore, an increasing amount of the propellant is exposed to and ignited by the hot propellant gases. The gas production rate is directly coupled to and therefore effectively metered by the projectile acceleration, which is a function of the constant projectile mass. The ballistic pressure very quickly achieves a constant value, the magnitude of which, for a given system, is determined by the wall thickness of the propellant grain. As shown in FIG. 3, the constant pressure acceleration of the projectile continues until the entire grain is consumed, which occurs shortly after the base of the projectile has passed into the gun tube. The projectile continues to accelerate until it is ejected from the gun, while the bore pressure drops off due to the expansion of the propellant gases.

From the foregoing, it will be readily apparent that the present invention posesses numerous advantages not found in prior art devices. For example, the pressure vs time history shown in FIG. 3 represents an ideal configuration from the standpoint of piezometric efficiency. This is a consequence of the fact that the surface area development of the propellant grain during combustion is directly proportional to the projectile velocity. Thus an optimum interior ballistics is achieved which is a natural and inherently simple counterpart to the expendable breech gun. In addition, superior reproducibility of the firing impulse can be expected as a natural consequence of the projectile-metered combustion, improving system accuracy and facilitating the operation of a FOOB recoil system.

The propellant lined breechcase approach of this invention has an advantage over conventional gun ballistics, apart from more efficient performance, in that a single tubular propellant grain of uniform thickness is more easily fabricated and processed than conventional propellant grains which involve numerous precision perforations. Also, because it is tightly bonded to the breechcase, the tubular grain can be expected to have a significant structural advantage over conventional charges. The approach has an obvious advantage over the high/low ballistics system in that a heavy and difficult to manufacture high pressure combustion chamber is not required and either high or low pressure systems can be accomodated by the method.

The greatest inherent advantage of the present invention compared to conventional gun interior ballistic systems, however, is the extremely high volumetric loading density and design compactness afforded by the telescoped configuration. In a conventional gun chamber (behind the projectile), usually only 36–40 percent of the total chamber volume is filled with propellant, the balance constituting the normal initial free volume of the system. A higher loading density than this is difficult to achieve from a practical standpoint and often leads to pressure instabilities and greater erosive burning effects in the charge.

The technique of the present invention, on the other hand, intrinsically constitutes a nearly 100 percent volumetric loading and requires little if any initial free volume. In addition, since the propellant charge is concentrically distributed about the projectile over the entire length of the breechcase, the round is far more compact, or volumetrically efficient from a design standpoint. Thus the breechcase length in the new round need be only slightly greater than that of the projectile, and an increase in charge weight is achieved in radial increments, the volume increase being proportional to the square of that dimension.

Obviously, many modifications and variations of the present invention will readily occur to those skilled in the art. For example:

a. Designing the solid propellant liner to be deliberately brittle and hard so that it fractures behind the projectile when exposed to the full breech pressure and the accompanying radial expansion of the breechcase substrata. This would improve the structural capability of the propellant in guiding the motion of the projectile while greatly accelerating the burning rate of that portion of propellant which has been exposed by the projectile and thereby maximizing the coupling of the gas production rate to the projectile motion.

b. Using a gelled liquid monopropellant suspended within a porous matrix or an encapsulated liquid monopropellant inbedded within a combustible plastic matrix as the cylindrical propellant breechcase liner. This approach may provide a practical method for precisely controlling the combustion of liquid propellants to achieve the same piezometric efficiency as the solid grain while acquiring additional performance advantages normally derived from liquid propellants (i.e. low temperature combustion, high specific impetus, reduced muzzle flash, low molecular weight combustion products, etc.)

c. Fabricating the solid propellant liner with a number of small perforations molded, drilled, punched, or otherwise incorporated in the liner, all alligned in the radial direction. This type of geometry should enhance the net radial burn rate component, although at the same time it reduces the volumetric propellant loading density.

It is therefore to be understood that within the scope of the appended claims, the invention may be practiced otherwise than as specifically described.

What is claimed is:

1. A round for expendable breech guns comprising:

a hollow cylindrical one-shot breechcase closed at one end thereof;

a propellant liner bonded to the inner wall of said breechcase and extending substantially throughout its length;

a projectile disposed within and support by said liner; and means fixed in the closed end of said breechcase for facilitating ignition of said propellant.

2. A round as defined in claim 1 wherein the burning rate of the propellant varies directly with its distance from the closed end of said breechcase.

3. A round as defined in claim 2 wherein the variation in burning rate is obtained by a continuous variation in propellant formulation from closed end to open end of said breechcase.

4. A round as defined in claim 2 wherein the variation in burning rate is obtained by a plurality of adjacent cylindrical sections of propellant liner, each section further removed from the closed end of said breechcase having a higher burning rate than the preceeding section.

5. A round as defined in claim 1 wherein said breechcase is provided with a honeycomb liner and said propellant liner is dispersed within the intersticies thereof.

6. A round as defined in claim 5 wherein the burning rate of the propellant varies directly with its distance from the closed end of said breechcase.

7. A round as defined in claim 6 wherein the variation in burning rate is obtained by a continuous variation in propellant formulation from closed end to open open end of said breechcase.

8. A round as defined in claim 6 wherein the variation in burning rate is obtained by a plurality of adjacent cylindrical sections of propellant liner, each section further removed from the closed end of said breechcase having a higher burning rate than the preceeding section.

* * * * *